United States Patent [19]

Mlinek, Jr.

[11] Patent Number: 4,724,571

[45] Date of Patent: Feb. 16, 1988

[54] BRUSHING MACHINE TOOL WITH AUTOMATIC FEED

[75] Inventor: Frank J. Mlinek, Jr., Livonia, Mich.

[73] Assignee: General Motors Corporation, Detroit, Mich.

[21] Appl. No.: 934,202

[22] Filed: Nov. 24, 1986

[51] Int. Cl.[4] ..... A46B 13/02

[52] U.S. Cl. ..... 15/21 D; 51/72 R; 51/165.87

[58] Field of Search ..... 15/21 R, 21 D, 21 E, 15/34; 51/72 R, 165.87

[56] References Cited

U.S. PATENT DOCUMENTS 1,688,068 10/1928 Beyer ..... 51/72 R 2,928,112 3/1960 Nelson et al. ..... 15/21 D 3,064,290 11/1962 Bleke ..... 15/21 D 3,854,250 12/1974 Vornberger ..... 15/21 D

*Primary Examiner*—Edward L. Roberts

*Attorney, Agent, or Firm*—Donald F. Scherer

[57] ABSTRACT

A machine tool has a rotatable brush for abrading a workpiece. The brush and a drive motor are slidably disposed on guideways for movement toward and away from the workpiece. The brush and drive motor are connected to a counterweight which is sized to have a weight less than the weight of the brush and drive motor in an amount substantially equal to the desired brushing force. A power cylinder is arranged to withdraw the brush and motor from the workpiece after a predetermined amount of brush wear.

2 Claims, 3 Drawing Figures

BRUSHING MACHINE TOOL WITH AUTOMATIC FEED

BACKGROUND OF THE INVENTION

This invention relates to surface abrasion tools and more particularly to automatic feed wire brush machines.

SUMMARY OF THE INVENTION

It is an object of this invention to provide an improved wire brush machine tool wherein a counterweight is effective to maintain the brush in contact with the workpiece at the desired level of brushing force.

It is another object of this invention to provide an improved wire brush abrasion machine tool wherein a wire brush and drive motor assembly are acted upon by a counterweight which permits automatic feed against a workpiece to compensate for brush wear and also wherein a substantially constant brush force is applied to the workpiece.

DESCRIPTION OF THE PREFERRED EMBODIMENT

Figure 1:
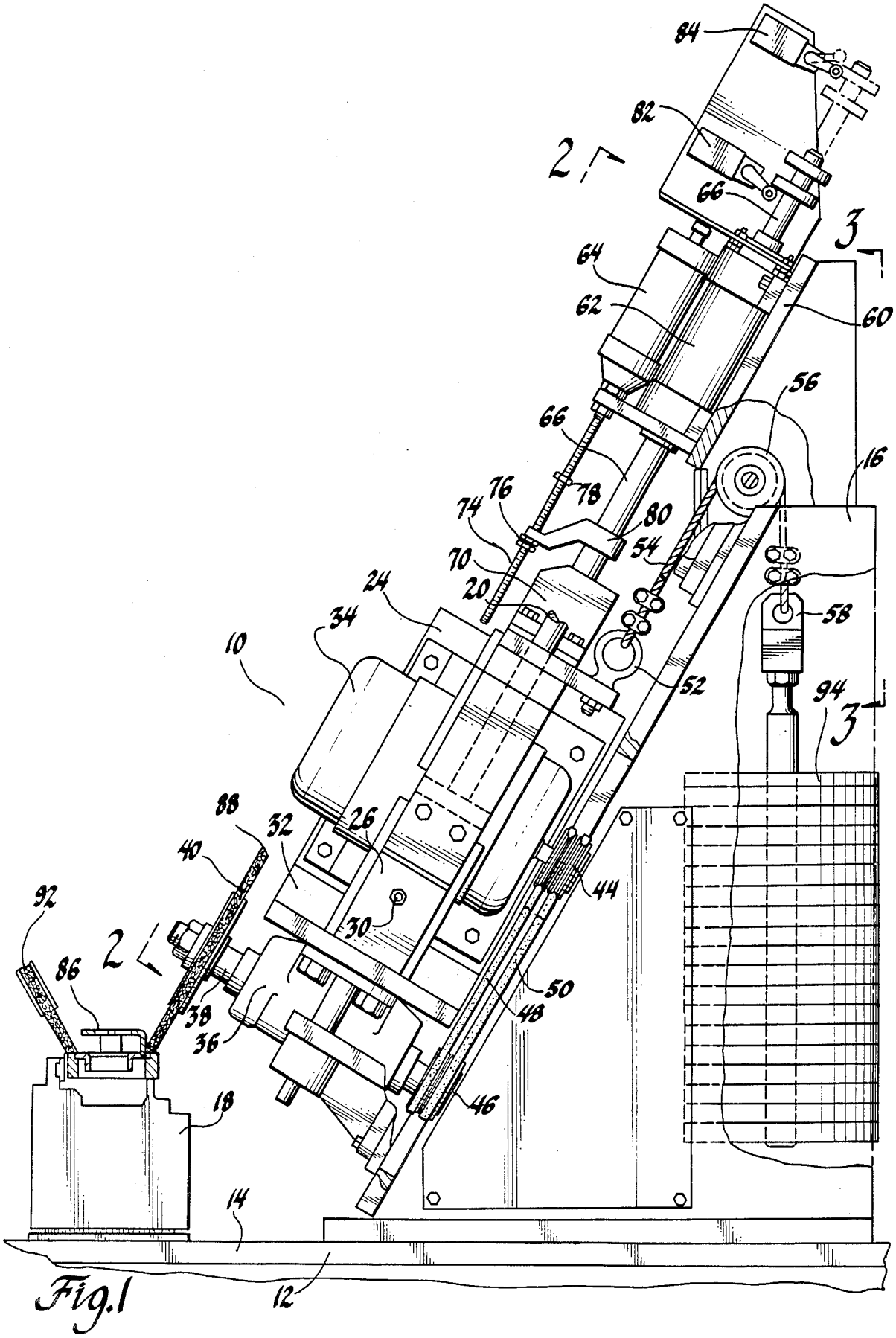
FIG. 1 is an elevational side view of a machine tool incorporating the invention.

Referring to the drawings, wherein like characters represent the same or corresponding parts throughout the several views, there is seen particularly in FIG. 1 a machine tool 10 having a frame 12 comprised of a base 14, an upright support 16 and a workpiece mount 18.

The upright support 16 has secured thereto a pair of guideways 20 and 22 on which is slidably disposed a motor and brush assembly 24. The motor and brush assembly 24 has incorporated therein bearing members 26 and 28 which slidably engage the guideways 20 and 22, respectively.

Figure 2:
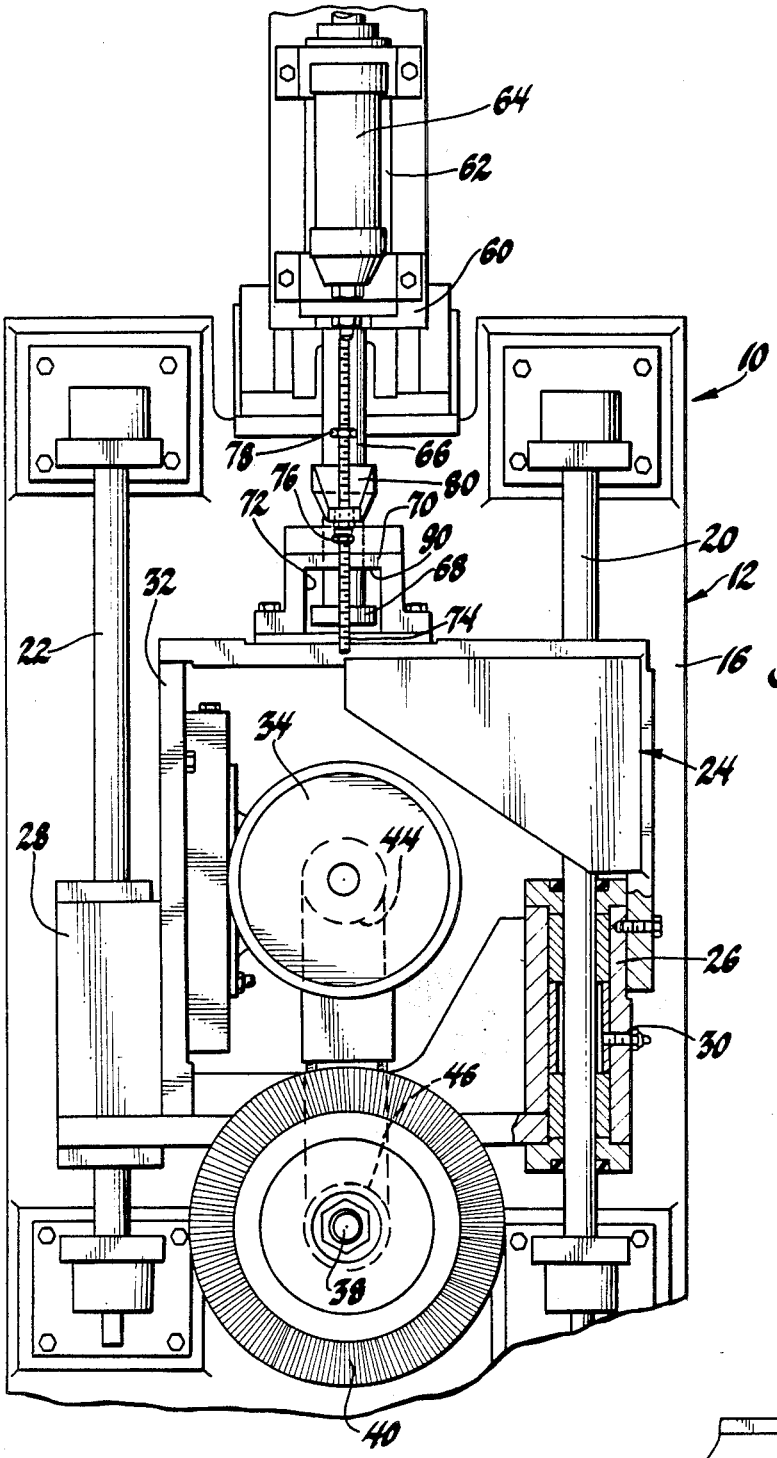
FIG. 2 is a view taken along line 2—2 of FIG. 1.
Figure 3:
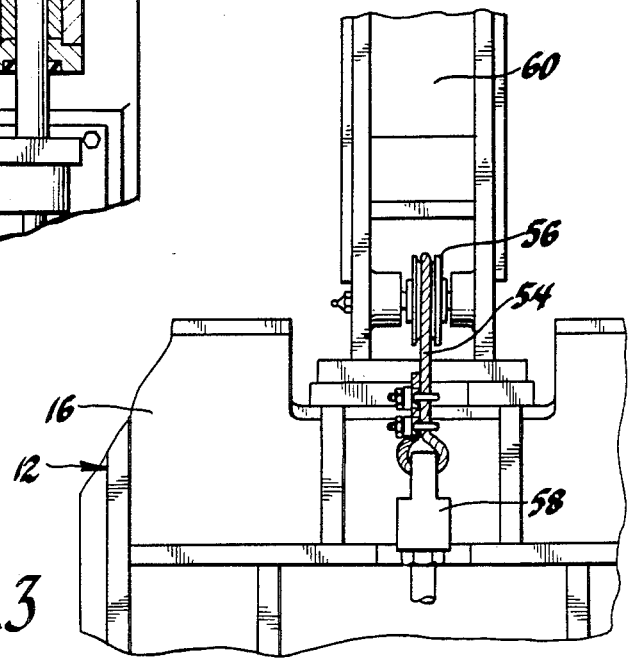
FIG. 3 is a view taken along line 3—3 of FIG. 1.

As best seen in FIG. 2, the bearing member 26 has a lubrication fitting 30 which permits lubricant to be forced into the bearing member to reduce the friction between guideway 20 and bearing member 26. The motor and brush assembly 24 also has a mounting base 32 to which is secured a conventional electrical motor 34. Also secured to the mounting base 32 is a bearing assembly 36 in which is rotatably supported a shaft 38. The shaft 38 has a conventional wire brush 40 secured thereto.

The motor 34 and shaft 38 have pulleys 44 and 46 respectively secured thereto. A pair of belts 48 and 50 are disposed to frictionally engage the pulleys to provide a rotary drive from the motor 34 to the brush 40. The mounting base 32 has an eye bolt 52 secured thereto which eye bolt 52 is in turn secured to a cable 54. The cable 54 is trained about a pulley 56 and secured to a counterweight 58.

The upright support 16 has a mounting pad 60 to which is secured a power cylinder 62 and a hydraulic check mechanism 64. The power cylinder 62 and hydraulic check 64 are commercially available units and can be purchased as a single unit.

The power cylinder 62 includes a rod member 66 which has an enlarged end 68. The enlarged end 68 of rod 66 is disposed in a housing 70 which is secured to the mounting base 32. The housing 70 has an internal cavity 72 which permits the enlarged end 68 a substantial degree of freedom without contacting the housing 70 or the base 32. This arrangement is best seen in FIG. 2.

The hydraulic check 64 includes a threaded stem 74 which has disposed thereon a pair of threaded members 76 and 78. A control arm 80 is secured to the rod 66 and slidably disposed along the threaded stem 74. The threaded members 76 and 78 permit the rod 66 to travel a predetermined distance prior to actuating the hydraulic check 64.

The power cylinder 62 is air-operated to provide rapid movement between the travel extremes. Such power cylinders are difficult to control at the end of their stroke. The hydraulic check 64 provides a deceleration control at each end of the stroke of the power cylinder 62. The power cylinder will move freely and rapidly when the arm 80 is between the threaded members 76 and 78. However, when the arm 80 engages either of these threaded members, the added resistance of the hydraulic check 64 is imposed on the power cylinder 62 thus rapidly decreasing or decelerating its linear velocity.

A pair of limit switches 82 and 84 are also disposed on the mounting pad 60 to provide control signals to the pneumatic control for the power cylinder 62. The control of the power cylinder 62 is preferably electropneumatic and of conventional design.

The workpiece mounting 18 is adapted to hold a workpiece such as a carrier 86. The carrier 86 is a conventional element which is used in a planetary gearing arrangement to support the planet pinion gears. The carrier 86 is a fabricated assembly which will have surfaces that should be cleaned prior to assembly into the transmission. A brushing operation can provide for a cleaning of the surfaces.

As seen in FIG. 1, the brush 40 has a wire brushing surface which is in contact with the carrier 86. During the brushing operation, it is important to maintain the brush in contact with the work surface at a force level that will not cause significant bending or deflection of the brush bristles. In the arrangement shown, it is desired to have a brushing force of approximately 60 pounds. This is accomplished by providing a 60 pound difference between the counterweight 58 and the motor and brush assembly 24. The frictional losses are negligible due to the lubrication of the bearings 26 and 28.

Also, during the brushing operation, the brush surface 88 is subject to wear. When this occurs with the present invention, the motor and brush assembly 24 will automatically move toward the workpiece whenever brush wear occurs to maintain a constant brushing force. It is also desirable in brushing operations to limit the brush wear to a predetermined amount.

This is accomplished by the lost motion connection provided between the housing 70 and the enlarged end 68 of rod 66. As best seen in FIG. 2, the inside upper surface 90 of housing 70 will approach the enlarged end 68 when the motor and brush assembly 24 moves downward on the guideways 20 and 22 due to brush wear. When the surface 90 contacts the enlarged end 68, further movement cannot occur thus limiting the brush wear. The motor and brush assembly 24 can be retracted by the power cylinder 62 after this contact is made.

When the power cylinder 62 is energized to retract the assembly 24, the limit switch 84 will control the end travel of rod 66 as shown in phantom position in FIG. 1. This position is also assumed by the power cylinder 62 whenever the workpiece is to be removed or installed on the workpiece mount 18. The inward motion of the rod 66 of power cylinder 62 is controlled by the limit switch 82 as seen in solid lines of FIG. 1.

If desired, it is possible to incorporate a third limit switch within the housing 70 which is triggered whenever the brush wear reaches its predetermined value to cause automatic retraction of the motor and brush assembly 24. It is also possible to use more than one machining tool to operate on a single workpiece.

For example, a brush 92 is shown in FIG. 1 which would be the component of a machine tool disposed to the left of the carrier 86. The shape of the brushing surface 88 can be reconfigured as desired to accommodate various workpieces. The brushing force can be adjusted by adding weights, such as those shown at 94, to the counterweight 58 to decrease the brushing force or removing weights from the counterweight 58 to increase the brushing force. This provides a flexibility for the machine tool in that a variety of workpieces can be operated on and the brush force can be tailored to the specific surface and/or material to be abraded.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A machine tool for working a surface of a workpiece comprising: a frame member; mounting means on said frame member for holding a workpiece having a surface to be brushed; drive means movably mounted on said frame member; wire brush means secured to said drive means and being rotated thereby, said brush means including an outer peripheral brush surface subject to wear during working; counterweight means connected to said drive means for permitting movement thereof to continually position said outer peripheral brush surface against the surface of said workpiece with a predetermined brushing force; and power cylinder means for selectively moving said drive means in one direction to prevent contact of said brush surface and said workpiece surface when working is not desired and for limiting movement of said drive means and said wire brush means in the other direction to limit the amount of movement of said counterweight and the amount of wear of the outer peripheral brush surface.

2. A machine tool for working a surface of a workpiece comprising: a frame member; workpiece mounting means on said frame member for holding a workpiece having a surface to be brushed; second mounting means movably mounting drive means and wire brush means on said frame member, said brush means including an outer peripheral brush surface subject to wear during working; counterweight means; cable means connecting said counterweight means to said drive means, said counterweight means being sized for permitting movement of said outer peripheral brush surface against the surface of said workpiece with a predetermined brushing force; power cylinder means having a rod member selectively movable to two positions; and housing means on said second mounting means cooperating with said rod member for selectively moving said second mounting means to one of said positions to prevent contact of said brush surface and said workpiece surface when working is not desired and for limiting movement of said second mounting means in the other direction at said other position to limit the amount of wear of the outer peripheral brush surface, and said housing means being out of contact and spaced from said rod member by an amount equal to the amount of brush wear to be permitted prior to the occurrence of any brush wear when the rod member is in said other position.

* * * * *